US010329636B2

(12) United States Patent
Takashima et al.

(10) Patent No.: US 10,329,636 B2
(45) Date of Patent: Jun. 25, 2019

(54) HIGH-STRENGTH COLD-ROLLED STEEL SHEET WITH EXCELLENT MATERIAL HOMOGENEITY AND PRODUCTION METHOD THEREFOR

(71) Applicant: JFE STEEL CORPORATION, Tokyo (JP)

(72) Inventors: Katsutoshi Takashima, Chiba (JP); Kohei Hasegawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 298 days.

(21) Appl. No.: 15/301,097

(22) PCT Filed: Mar. 17, 2015

(86) PCT No.: PCT/JP2015/001456
§ 371 (c)(1),
(2) Date: Sep. 30, 2016

(87) PCT Pub. No.: WO2015/151428
PCT Pub. Date: Oct. 8, 2015

(65) Prior Publication Data

US 2017/0022582 A1 Jan. 26, 2017

(30) Foreign Application Priority Data

Mar. 31, 2014 (JP) ..... 2014-073269

(51) Int. Cl.

| | |
|---|---|
| ***C21D 9/46*** | (2006.01) |
| ***C21D 1/25*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/34*** | (2006.01) |
| ***C22C 38/38*** | (2006.01) |
| ***C22C 38/58*** | (2006.01) |
| ***C22C 38/00*** | (2006.01) |
| ***C21D 8/04*** | (2006.01) |
| ***B22D 11/00*** | (2006.01) |
| ***C22C 38/08*** | (2006.01) |
| ***C22C 38/12*** | (2006.01) |
| ***C22C 38/16*** | (2006.01) |
| ***C22C 38/28*** | (2006.01) |
| ***C22C 38/32*** | (2006.01) |

(52) U.S. Cl.

CPC ..... *C21D 9/46* (2013.01); *B22D 11/001* (2013.01); *C21D 1/25* (2013.01); *C21D 8/021* (2013.01); *C21D 8/0226* (2013.01); *C21D 8/0263* (2013.01); *C21D 8/0273* (2013.01); *C21D 8/0473* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/32* (2013.01); *C22C 38/34* (2013.01); *C22C 38/38* (2013.01); *C22C 38/58* (2013.01); *C21D 2211/001* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2011/0005643 | A1* | 1/2011 | Murakami | C21D 1/25 148/331 |
| 2012/0009434 | A1 | 1/2012 | Hata et al. | |
| 2013/0040165 | A1 | 2/2013 | Shiraki et al. | |
| 2013/0133792 | A1* | 5/2013 | Nakagaito | C21D 1/25 148/645 |

(Continued)

FOREIGN PATENT DOCUMENTS

| | | | |
|---|---|---|---|
| CN | 101641456 | A | 2/2010 |
| CN | 101932745 | A | 12/2010 |
| CN | 101932746 | A | 12/2010 |

(Continued)

OTHER PUBLICATIONS

Oct. 13, 2015 Office Action issued in Japanese Patent Application No. 2015-536682.
Mar. 8, 2017 Extended European Search Report issued in European Patent Application No. 15773182.9.
Delesse, M. "Procede mechanique pour determiner la composition des roches," Annales Des Mines, vol. 13, Jan. 1, 1848 pp. 379-388.

(Continued)

*Primary Examiner* — Helene Klemanski
(74) *Attorney, Agent, or Firm* — Oliff PLC

(57) ABSTRACT

A high-strength cold-rolled steel sheet having good ductility, hole expandability, and delayed fracture resistance and being excellent in material homogeneity. The steel sheet has a chemical composition containing, in mass %, C: 0.15 to 0.25%, Si: 1.2 to 2.2%, Mn: 1.7 to 2.5%, P: 0.05% or less, S: 0.005% or less, Al: 0.01 to 0.10%, N: 0.006% or less, Ti: 0.003 to 0.030%, B: 0.0002 to 0.0050%, and Fe and inevitable impurities. The steel sheet has a microstructure that includes ferrite having an average crystal grain diameter of 4 μm or less at a volume fraction of 5 to 20%, retained austenite at a volume fraction of 5% or less, including 0%, and tempered martensite at a volume fraction of 80 to 95%. Additionally, the mean free path of the ferrite is 3.0 to 7.5 μm.

18 Claims, No Drawings

(56) References Cited

U.S. PATENT DOCUMENTS

| | | | | |
|---|---|---|---|---|
| 2017/0107591 | A1* | 4/2017 | Takashima | C21D 9/46 |
| 2017/0145534 | A1* | 5/2017 | Takashima | C21D 8/0226 |

FOREIGN PATENT DOCUMENTS

| | | | |
|---|---|---|---|
| CN | 102149840 | A | 8/2011 |
| CN | 102884218 | A | 1/2013 |
| CN | 102971442 | A | 3/2013 |
| CN | 103069040 | A | 4/2013 |
| CN | 103857819 | A | 6/2014 |
| CN | 104160055 | A | 11/2014 |
| EP | 1 143 019 | A1 | 10/2001 |
| EP | 2 128 295 | A1 | 12/2009 |
| EP | 2 246 456 | A1 | 11/2010 |
| EP | 2 258 887 | A1 | 12/2010 |
| EP | 2 325 346 | A1 | 5/2011 |
| EP | 2 546 382 | A1 | 1/2013 |
| EP | 2 589 674 | A1 | 5/2013 |
| EP | 2 604 715 | A1 | 6/2013 |
| EP | 2 765 212 | A1 | 8/2014 |
| EP | 2762581 | A1 | 8/2014 |
| EP | 2 824 210 | A1 | 1/2015 |
| JP | 2010-018862 | A | 1/2010 |
| JP | 2010-126770 | A | 6/2010 |
| JP | 2010-215958 | A | 9/2010 |
| JP | 2012-031462 | A | 2/2012 |
| JP | 2013-060657 | A | 4/2013 |
| JP | 2014-080665 | A | 5/2014 |
| WO | 2013/046697 | A1 | 4/2013 |

OTHER PUBLICATIONS

May 10, 2017 Office Action issued in Chinese Patent Application No. 201580017145.5.

Jun. 16, 2015 Search Report issued in International Patent Application No. PCT/JP2015/001456.

* cited by examiner

HIGH-STRENGTH COLD-ROLLED STEEL SHEET WITH EXCELLENT MATERIAL HOMOGENEITY AND PRODUCTION METHOD THEREFOR

TECHNICAL FIELD

The present disclosure relates to a high-strength cold-rolled steel sheet and to a production method therefor. Particularly, the present disclosure relates to a high-strength cold-rolled steel sheet with excellent material homogeneity and suitable for members of structural components of automobiles etc. and to a production method for the steel sheet.

BACKGROUND ART

From the viewpoint of reducing the weight of automobile bodies and of automobile crash safety, high-strength steel sheets are being increasingly applied to various structural members and reinforcing members of automobiles. For practical use of the high-strength steel sheets, these high-strength steel sheets have a need for improved press-formability. Particularly, to form a high-strength steel sheet into a component having a complex shape, it is necessary that not only one of the properties of the steel sheet such as ductility and hole expandability be good but also both the properties be good.

On the other hand, a high strength steel sheet that is reduced in thickness sees significant impairment in shape fixability. For this reason, it is a widespread practice to perform press forming by predicting change in shape of pressed parts separated from the mold so as to design the press mold in expectation of the change in shape. Here, if the tensile strength of a steel sheet is changed significantly, the actual change in shape deviate from the expected change based on the assumption that the tensile strength would remained unchanged, which leads to shape defects, making indispensable the procedure of subjecting the pressed parts one by one to sheet processing for shape correction, with the result that mass-production efficiency is significantly deteriorated. In view of this, there has been a demand for high strength steel sheets with minimized difference in strength, that is, having excellent material homogeneity.

Particularly, in a thin high-strength steel sheet having a tensile strength (TS) of more than 1,450 MPa, residual stress after press forming and hydrogen entering from the environment may cause delayed fracture. Therefore, when a high-strength cold-rolled steel sheet is used as the above-described thin steel sheet for automobiles, it is necessary that the steel sheet have high press-formability, i.e., be excellent in ductility and hole expandability (hereinafter may be referred to also as stretch flangeability), and also have excellent material homogeneity and excellent delayed fracture resistance.

Various techniques for achieving formability and delayed fracture resistance simultaneously are previously known. For example, Patent Literature 1 discloses a high-strength cold-rolled steel sheet having excellent bendability and delayed fracture resistance. This steel sheet has a prescribed chemical composition comprising Si: 1.0 to 2.0% and has a metal structure in which the volume fraction of a tempered martensite phase is 97% or more and the volume fraction of a retained austenite phase is less than 3% (in all regions except for a region within a depth of 10 μm from the surface of the steel sheet). This steel sheet has a tensile strength of 1,470 MPa or more, and the ratio of its 0.2% proof stress to the tensile strength is 0.80 or more. In Patent Literature 1, it is stated that the addition of Si allows the work hardening ability of the tempered martensite phase to be improved and fine carbides to be dispersed uniformly in the structure, so that a cold-rolled steel sheet having a very high tensile strength of 1,470 MPa or more and also having high bendability and excellent delayed fracture resistance can be obtained.

Patent Literature 2 discloses a high-strength cold-rolled steel sheet having excellent hydrogen embrittlement resistance and formability. This steel sheet has a prescribed chemical composition comprising V: 0.001 to 1.00% and has a structure in which the area fraction of tempered martensite is 50% or more (including 100%) and the remainder is ferrite. The distribution state of precipitates in the tempered martensite is as follows. The number of precipitate particles having an equivalent circular diameter of 1 to 10 nm per 1 $\mu m^2$ in the tempered martensite is 20 or more, and the number of V-containing precipitate particles having an equivalent circular diameter of 20 nm or more per 1 $\mu m^2$ in the tempered martensite is 10 or less. In Patent Literature 2, it is stated that, by appropriately controlling the area fraction of the tempered martensite and the distribution state of the V-containing precipitate precipitated in the tempered martensite in a tempered martensite single-phase structure or a two-phase structure including the ferrite and the tempered martensite, stretch flangeability is improved while hydrogen embrittlement resistance is ensured.

CITATION LIST

Patent Literature

PTL 1: Japanese Unexamined Patent Application Publication No. 2010-215958

PTL 2: Japanese Unexamined Patent Application Publication No. 2010-018862

SUMMARY

Technical Problem

However, Patent Literature 1 does not disclose any technique for ensuring the above-described hole expandability and material homogeneity, which are important for press forming. With the technique in Patent Literature 1, segregation of Mn etc. caused particularly by cooling of a slab is present in the steel sheet, so that the material homogeneity tends to deteriorate. With the technique in Patent Literature 2, ductility is insufficient for a tensile strength of 1,450 MPa or more, and sufficient formability is not ensured.

As described above, in high-strength steel sheets having a tensile strength of 1,450 MPa or more, it is difficult to ensure material homogeneity and delayed fracture resistance while excellent ductility and hole expandability during press forming are ensured. At present, steel sheets (including those having the above tensile strength and other steel sheets) having all the above properties (strength, ductility, hole expandability, delayed fracture resistance, material homogeneity) have not been developed.

The present disclosure has been made in view of the foregoing circumstances, and it is an object to solve the problems in the conventional techniques to thereby provide a high-strength cold-rolled steel sheet excellent in ductility, hole expandability, and delayed fracture resistance and having excellent material homogeneity and to provide a production method for the high-strength cold-rolled steel sheet.

Solution to Problem

The present inventors have conducted extensive studies and found that excellent material homogeneity, excellent ductility, excellent hole expandability, and excellent delayed fracture resistance can be obtained as follows. A steel structure composed mainly of ferrite and tempered martensite is formed, and the volume fractions of the ferrite, the tempered martensite, and retained austenite and the average crystal grain diameter of the ferrite are controlled to prescribed ratios. In addition, optimal heat treatment is performed. The present disclosure is based on the above findings.

Specifically, the present inventors have clarified that variations in the material properties of a hot-rolled steel sheet can be reduced by: cooling a steel slab obtained by continuous casting to 600° C. within 6 hours to minimize segregation in the slab and decrease the crystal grains in size before hot rolling; and then controlling thermal history in a range of from finishing delivery temperature in a hot rolling step to coiling temperature, particularly a cooling rate, to disperse pearlite uniformly in the structure of the steel sheet. The present inventors have also clarified that, when the above hot-rolled steel sheet is cold-rolled and then annealed, the ferrite in the annealed cold-rolled steel sheet is dispersed finely, so that the variations in material properties can be reduced. The present inventors have also found that, when the ferrite is uniformly dispersed in the steel structure, void linkage, which causes deterioration of hole expandability, is suppressed, so that the hole expandability is improved.

To obtain a high-strength steel sheet having a TS of 1,450 MPa or more, it is effective to improve hardenability during continuous annealing by addition of Mn. However, the increase in the amount of Mn increases slip constraint at grain boundaries when hydrogen enters the steel sheet, and cracks easily propagate along the grain boundaries, so that the delayed fracture resistance is reduced. Another problem is that segregation causes significant deterioration of material homogeneity. To improve both the problems, the present inventors have found that addition of B is effective. Specifically, the present inventors have found the following. The addition of B strengthens the grain boundaries and is therefore very effective at improving the delayed fracture resistance. B retards the transformation from austenite to ferrite under cooling during continuous annealing and therefore contributes to an increase in strength. In addition, B present in the grain boundaries exhibits the effect of controlling element partitioning during cooling. Therefore, B also contributes to an improvement in the material homogeneity.

Accordingly, the present inventors have found the following. Mn is added within the range of from 1.7 to 2.5%, and B is added within the range of from 0.0002% to 0.0050%. Heat treatment is performed under appropriate slab cooling, hot rolling, and annealing conditions. As a result of the heat treatment, ferrite crystal grains are decreased in size and dispersed uniformly, and the volume fractions of the ferrite, tempered martensite, and retained austenite are controlled so as not to impair strength and ductility. In this manner, high ductility, high hole expandability, and improved delayed fracture resistance are achieved, and a cold-rolled steel sheet having excellent material homogeneity can be obtained.

The present disclosure is based on the above findings, and exemplary disclosed embodiments are as follows.

[1] A high-strength cold-rolled steel sheet with excellent material homogeneity, the high-strength cold-rolled steel sheet having a chemical composition comprising, in mass %, C: 0.15 to 0.25%, Si: 1.2 to 2.2%, Mn: 1.7 to 2.5%, P: 0.05% or less, S: 0.005% or less, Al: 0.01 to 0.10%, N: 0.006% or less, Ti: 0.003 to 0.030%, and B: 0.0002 to 0.0050%, with the balance being Fe and inevitable impurities, the steel sheet having a microstructure including ferrite having an average crystal grain diameter of 4 μm or less at a volume fraction of 5 to 20%, retained austenite at a volume fraction of 5% or less (including 0%), and tempered martensite at a volume fraction of 80 to 95%, and the ferrite having a mean free path of 3.0 to 7.5 μm.

[2] The high-strength cold-rolled steel sheet with excellent material homogeneity according to [1] above, wherein the chemical composition further comprises, in mass %, Nb: 0.05% or less.

[3] The high-strength cold-rolled steel sheet with excellent material homogeneity according to [1] or [2] above, wherein the chemical composition further comprises, in mass %, V: 0.01 to 0.30%.

[4] The high-strength cold-rolled steel sheet with excellent material homogeneity according to any of [1] to [3] above, wherein the chemical composition further comprises, in mass %, at least one selected from Cr: 0.30% or less and Mo: 0.30% or less.

[5] The high-strength cold-rolled steel sheet with excellent material homogeneity according to any of [1] to [4] above, wherein the chemical composition further comprises, in mass %, at least one selected from Cu: 0.50% or less and Ni: 0.50% or less.

[6] The high-strength cold-rolled steel sheet with excellent material homogeneity according to any of [1] to [5] above, wherein the chemical composition further comprises, in mass %, 0.0050% or less in total of Ca and/or a REM.

[7] A production method for a high-strength cold-rolled steel sheet with excellent material homogeneity, the production method comprising: continuously casting molten steel having the chemical composition according to any of [1] to [6] above to obtain a slab; cooling the slab subjected to the continuous casting to 600° C. within 6 hours; reheating the cooled slab; hot rolling the resulting slab under the conditions of a hot rolling start temperature of 1,150 to 1,270° C. and a finishing delivery temperature of 850 to 950° C.; starting cooling within 1 second after completion of the hot rolling; performing first cooling to 650° C. or lower at a first average cooling rate of 80° C./s or more; performing second cooling to 585° C. or lower at a second average cooling rate of 5° C./s or more; performing coiling; then performing cold rolling; and then performing continuous annealing including heating to a temperature range of from 800° C. to Ac3 transformation temperature at an average heating rate of 3 to 30° C./s, holding at a first soaking temperature within a temperature range of from 800° C. to the Ac3 transformation temperature for 30 seconds or longer, performing primary cooling to a primary cooling finish temperature of 650° C. or higher at a third average cooling rate of 1° C./s or more, performing cooling from the primary cooling finish temperature to 100° C. or lower at a fourth average cooling rate of 100 to 1,000° C./s, and then holding in a second soaking temperature range of from 100 to 250° C. for 120 to 1,800 seconds.

Advantageous Effects

In the present disclosure, the chemical composition and microstructure of the steel sheet are controlled. This allows a high-strength cold-rolled steel sheet with excellent material homogeneity and excellent in ductility, hole expandability, and delayed fracture resistance to be stably obtained. Specifically, this cold-rolled steel sheet has a high tensile strength of 1,450 MPa or more, an elongation of 10.5% or more, and a hole expansion ratio of 30% or more, and fracture does not occur for 100 hours in an environment in which the cold-rolled steel sheet is immersed in hydrochloric acid with pH=2 at 25° C. As for the TS, ΔTS is defined as the difference between the TS value at a widthwise central portion of the sheet and the TS value at a position one-eighth of the width of the sheet (specifically, the average of the TS values at two positions one-eighth of the width of the sheet on opposite sides) (the absolute value of {(the characteristic value at the widthwise central portion of the sheet)−(the characteristic value at the positions one-eighth of the width of the sheet)}). In the present disclosure, ΔTS≤40 MPa holds, and therefore excellent material homogeneity is achieved.

DESCRIPTION OF EMBODIMENTS

First, a description will be given of the reasons for the limitations on the chemical composition of the high-strength cold-rolled steel sheet of the disclosed embodiments. In the following description, "%" for each component means % by mass.

C: 0.15 to 0.25%

C is an element effective in strengthening the steel sheet, contributes to the formation of second phases other than ferrite such as tempered martensite and retained austenite in the present disclosure, and increases the hardness of the tempered martensite. If the content of C is less than 0.15%, it is difficult to ensure the volume fractions of the ferrite and the tempered martensite. Therefore, the content of C is 0.15% or more. Preferably, the content of C is 0.16% or more. If C is added excessively, i.e., added in an amount of more than 0.25%, the difference in hardness between the ferrite and the tempered martensite becomes large, so that hole expandability decreases. Therefore, the content of C is 0.25% or less. Preferably, the content of C is 0.23% or less.

Si: 1.2 to 2.2%

Si has an influence on solid solution strengthening of the ferrite and contributes to an increase in strength. To achieve this effect, the content of Si must be 1.2% or more. Preferably, the content of Si is 1.4% or more. However, the addition of an excessive amount of Si causes a reduction in chemical conversion treatability. Therefore, the content of Si is 2.2% or less. Preferably, the content of Si is 2.0% or less.

Mn: 1.7 to 2.5%

Mn is an element that contributes to an increase in strength through solid solution strengthening and the formation of second phases. To achieve this effect, the content of Mn must be 1.7% or more. Preferably, the content of Mn is 1.9% or more. If Mn is contained excessively, i.e., in an amount of more than 2.5%, the volume fraction of martensite becomes excessive. In this case, the hardness of the tempered martensite becomes high, and the hole expandability decreases. In addition, when the content of Mn exceeds 2.5%, slip constraint at grain boundaries increases when hydrogen enters the steel sheet, and cracks easily propagate along the grain boundaries, so that the delayed fracture resistance is reduced. In addition, segregation in the slab causes deterioration of the material homogeneity. Therefore, the content of Mn is 2.5% or less. Preferably, the content of Mn is 2.3% or less.

P: 0.05% or less

P contributes to an increase in strength through solid solution strengthening. However, if P is added excessively, significant segregation of P on grain boundaries occurs. This causes embrittlement of the grain boundaries and a reduction in weldability. Therefore, the content of P is 0.05% or less. Preferably, the content of P is 0.03% or less.

S: 0.005% or less

When the content of S is large, a large amount of sulfides such as MnS are formed, and this causes a reduction in hole expandability and delayed fracture resistance. Therefore, the content of S is 0.005% or less. Preferably, the content of S is 0.004% or less. The lower limit is not particularly specified. However, an extreme reduction in S content causes an increase in steelmaking cost. Therefore, the content of S is preferably 0.0005% or more.

Al: 0.01 to 0.10%

Al is an element necessary for deoxidization. To achieve this effect, the content of Al must be 0.01% or more. If the content of Al exceeds 0.10%, the above effect is saturated. Therefore, the content of Al is 0.10% or less. Preferably, the content of Al is 0.05% or less.

N: 0.006% or less

N forms coarse nitrides and causes deterioration of bendability and stretch flangeability, and therefore the content of N must be reduced. The above tendency becomes significant when the content of N exceeds 0.006%. Therefore, the content of N is 0.006% or less. Preferably, the content of N is 0.005% or less.

Ti: 0.003 to 0.030%

Ti is an element that forms fine carbonitride and can thereby contribute to an increase in strength. Ti is necessary in order to prevent B, which is an essential element in the present disclosure, from reacting with N. The reason that B is prevented from reacting with N is that the formation of BN in the steel sheet causes a reduction in delayed fracture resistance. To achieve this effect, the content of Ti is 0.003% or more. Preferably, the content of Ti is 0.005% or more. If the content of Ti is large, i.e., exceeds 0.030%, ductility is reduced significantly. Therefore, the content of Ti is 0.030% or less. Preferably, the content of Ti is 0.025% or less.

B: 0.0002 to 0.0050%

B is an element that increases hardenability, contributes to an increase in strength through the formation of a second phase, and allows hardenability to be ensured without an increase in the hardness of the tempered martensite. B is also effective for the delayed fracture resistance through grain boundary strengthening. B is also effective in dispersing pearlite when cooling is performed after finishing rolling during hot rolling. To obtain these effects, the content of B is 0.0002% or more. Even when the content of B exceeds 0.0050%, these effects are saturated. Therefore, the content of B is 0.0050% or less. Preferably, the content of B is 0.0040% or less.

In the disclosed embodiments, in addition to the components described above, at least one selected from Nb: 0.05% or less, V: 0.01 to 0.30%, Cr: 0.30% or less, and Mo: 0.30% or less, at least one selected from Cu: 0.50% or less and Ni: 0.50% or less, and 0.0050% or less in total of Ca and/or a REM may be added separately or simultaneously for the following reasons.

Nb: 0.05% or less

Nb forms fine carbonitride and can thereby contribute to an increase in strength. Therefore, Nb has the same effect as Ti and may be added as needed. To achieve this effect, the content of Nb is preferably 0.005% or more. If the amount of Nb added is large, i.e., more than 0.05%, ductility is reduced significantly. Therefore, the content of Nb is 0.05% or less.

V: 0.01 to 0.30%

V forms fine carbonitride and can thereby contribute to an increase in strength, as does Nb. Since V has the above action, the content of V is 0.01% or more. Even when the amount of V contained is large, i.e., more than 0.30%, the strength increasing effect obtained by the excess amount of V over 0.30% is small, and this leads to an increase in the cost of alloying. Therefore, the content of V is 0.30% or less.

Cr: 0.30% or less

Cr is an element that contributes to an increase in strength through the formation of a second phase and may be added as needed. To achieve this effect, the content of Cr is preferably 0.10% or more. If the content of Cr exceeds 0.30%, an excessively large amount of tempered martensite is formed. Therefore, the content of Cr is 0.30% or less.

Mo: 0.30% or less

Mo is an element that contributes to an increase in strength through the formation of a second phase, and part of Mo forms carbide to thereby contribute to an increase in strength. Mo may be added as needed. To achieve these effects, the content of Mo is preferably 0.05% or more. Even when the amount of Mo contained exceeds 0.30%, these effects are saturated. Therefore, the content of Mo is 0.30% or less.

Cu: 0.50% or less

Cu is an element that contributes to an increase in strength through the formation of a second phase, as is Mo. Cu is also an element that contributes to an increase in strength through solid solution strengthening. Cu also improves delayed fracture characteristics and may be added as needed. To achieve these effects, the content of Cu is preferably 0.05% or more. Even when the amount of Cu contained exceeds 0.50%, these effects are saturated, and surface defects caused by Cu are likely to occur. Therefore, the content of Cu is 0.50% or less.

Ni: 0.50% or less

Ni is an element that contributes to an increase in strength through the formation of a second phase and contributes to an increase in strength through solid solution strengthening, as is Cu. Ni may be added as needed. To achieve these effects, the content of Ni is preferably 0.05% or more. When Ni is added together with Cu, the effect of suppressing surface defects caused by Cu is achieved. Therefore, Ni is effective when Cu is added. Even when the amount of Ni contained exceeds 0.50%, these effects are saturated. Therefore, the content of Ni is 0.50% or less.

0.0050% or less in total of Ca and/or REM

Ca and REMs are elements that spheroidize sulfides and thereby contribute to an improvement in the adverse effect of the sulfides on hole expandability and may be added as needed. To achieve this effect, the total amount of Ca and/or a REM contained is preferably 0.0005% or more. If the total amount of Ca and/or a REM contained exceeds 0.0050%, their effect is saturated. Therefore, the total amount of Ca and/or a REM contained is 0.0050% or less, irrespective of whether one of them or a combination of them is added.

The balance other than the above elements is Fe and inevitable impurities. Examples of the inevitable impurities include Sb, Sn, Zn, and Co. The allowable ranges of the contents of these elements are Sb: 0.01% or less, Sn: 0.05% or less, Zn: 0.01% or less, and Co: 0.10% or less. In the present disclosure, when Ta, Mg, and Zr are contained within the ranges for a general steel composition, the effects of the present disclosure are not lost.

Next, the microstructure of the high-strength cold-rolled steel sheet of the disclosed embodiments will be described in detail.

The high-strength cold-rolled steel sheet of the present disclosure has a microstructure including ferrite having an average crystal grain diameter of 4 μm or less at a volume fraction of 5 to 20%, retained austenite at a volume fraction of 5% or less (including 0%), and tempered martensite at a volume fraction of 80 to 95%, and the mean free path of the ferrite is 3.0 to 7.5 μm. In the following description, each volume fraction is a volume fraction with respect to the total volume of the steel sheet.

Ferrite having an average crystal grain diameter of 4 μm or less at a volume fraction of 5 to 20%

If the volume fraction of the ferrite exceeds 20%, the amount of voids formed during punching increases, so that it is difficult to obtain strength and hole expandability simultaneously. Therefore, the volume fraction of the ferrite is 20% or less. The volume fraction of the ferrite is preferably 17% or less and more preferably 15% or less. If the volume fraction of the ferrite is less than 5%, the ductility deteriorates. Therefore, the volume fraction of the ferrite is 5% or more. Preferably, the volume fraction of the ferrite is 7% or more. If the average crystal grain diameter of the ferrite exceeds 4 μm, voids formed in a punched edge during hole expansion are easily linked during the hole expansion, so that good hole expandability is not obtained. Therefore, the average crystal grain diameter of the ferrite is 4 μm or less. Preferably, the average crystal grain diameter of the ferrite is 3 μm or less.

Mean free path of the ferrite: 3.0 to 7.5 μm

If the mean free path of the ferrite in the structure of the steel sheet is less than 3.0 μm, the number of voids formed during punching becomes large, and the voids are easily linked during hole expansion. In this case, the hole expandability deteriorates, and the material homogeneity is reduced. Therefore, the mean free path of the ferrite is 3.0 μm or more. Preferably, the mean free path of the ferrite is 3.2 μm or more. If the mean free path of the ferrite is more than 7.5 μm, although the number of voids during punching is small, the area of the voids becomes large. In this case, the voids are easily linked during hole expansion, and the hole expandability deteriorates. In addition, the material homogeneity is reduced. Therefore, the mean free path of the ferrite is 7.5 μm or less. Preferably, the mean free path of the ferrite is 7.3 μm or less.

The mean free path of the ferrite is computed using formula (1) below.

[Formula 1]

$$L_M = \frac{d_M}{2}\left(\frac{4\pi}{3f}\right)^{\frac{1}{3}} \tag{1}$$

In the above formula, $L_M$ is the mean free path, $d_M$ is the average crystal grain diameter (μm) of the ferrite, π is the circular constant, and f is the volume fraction of the ferrite (=the volume fraction of the ferrite (%)/100).

Volume Fraction of the Retained Austenite: 5% or Less (Including 0%)

If the volume fraction of the retained austenite exceeds 5%, the hole expandability deteriorates. Therefore, the volume fraction of the retained austenite is 5% or less. Preferably, the volume fraction of the retained austenite is 3% or less. The volume fraction of the retained austenite may be 0%.

Volume Fraction of the Tempered Martensite: 80 to 95%

If the volume fraction of the tempered martensite is less than 80%, it is difficult to ensure a tensile strength of 1,450 MPa or more, and voids are easily linked during hole expansion, so that the hole expandability decreases. To ensure a tensile strength of 1,450 MPa or more and to ensure excellent hole expandability, the volume fraction of the tempered martensite is 80% or more. Preferably, the volume fraction of the tempered martensite is 85% or more. If the volume fraction of the tempered martensite exceeds 95%, the amount of ferrite that is large enough to ensure ductility cannot be obtained. Therefore, the volume fraction of the tempered martensite is 95% or less. Preferably, the volume fraction of the tempered martensite is 92% or less. The tempered martensite is martensite obtained by tempering, in a second soaking temperature range, martensite formed by cooling to 100° C. or lower at a fourth average cooling rate during continuous annealing.

In the microstructure of the present disclosure, bainite, pearlite, etc. may be formed in addition to the ferrite, tempered martensite, and retained austenite described above. However, the object of the present disclosure can be achieved so long as the above-described volume fractions of the ferrite, retained austenite, and tempered martensite and the above-described average crystal grain diameter and mean free path of the ferrite are satisfied. It is preferable that the total volume fraction of structures such as pearlite and bainite other than the ferrite, retained austenite, and tempered martensite described above is 5% or less.

Next, a production method for the high-strength cold-rolled steel sheet of the present disclosure will be described.

The high-strength cold-rolled steel sheet of the present disclosure can be produced by: continuously casting molten steel having a chemical composition compatible with the chemical composition ranges described above to obtain a slab; cooling the slab subjected to the continuous casting to 600° C. within 6 hours; reheating the cooled slab; hot rolling the resulting slab under the conditions of a hot rolling start temperature of 1,150 to 1,270° C. and a finishing delivery temperature of 850 to 950° C.; starting cooling within 1 second after completion of the hot rolling; performing first cooling to 650° C. or lower at a first average cooling rate of 80° C./s or more; performing second cooling to 585° C. or lower at a second average cooling rate of 5° C./s or more; performing coiling; then performing cold rolling; and then performing continuous annealing including heating to a temperature range of from 800° C. to Ac3 transformation temperature at an average heating rate of 3 to 30° C./s, holding at a first soaking temperature within a temperature range of from 800° C. to the Ac3 transformation temperature for 30 seconds or longer, performing primary cooling to a primary cooling finish temperature of 650° C. or higher at a third average cooling rate of 1° C./s or more, performing cooling from the primary cooling finish temperature to 100° C. or lower at a fourth average cooling rate of 100 to 1,000° C./s, and then holding in a second soaking temperature range of from 100 to 250° C. for 120 to 1,800 seconds.

As described above, the high-strength cold-rolled steel sheet of the present disclosure can be produced by sequentially performing: a hot rolling step of subjecting the steel slab to hot rolling and performing cooling and coiling; a cold rolling step of performing cold rolling; and an annealing step of performing continuous annealing. The conditions of production will next be described in detail.

In the disclosed embodiments, first, the slab is produced by a continuous casting method. This is because the production efficiency of the continuous casting method is higher than that of other casting methods such as an ingot casting method. Preferably, a continuous casting apparatus of the vertical bending type is used. This is because the vertical bending type is excellent in the balance between the cost of the facility and surface quality and because the effect of suppressing surface cracks is significant. After the continuous casting is performed to obtain the slab, the slab is cooled to 600° C. within 6 h (6 hours). If the time from the continuous casting to the cooling to 600° C. exceeds 6 h, the segregation of Mn etc. becomes significant, and the crystal grains become coarse. In this case, particularly, the mean free path of the ferrite increases, and the material homogeneity deteriorates. Therefore, the steel slab subjected to the continuous casting is cooled to 600° C. within 6 h. Preferably, the steel slab is cooled to 600° C. within 5 h. More preferably, the steel slab is cooled to 600° C. within 4 h. After the steel slab is cooled to 600° C., the steel slab may be cooled to room temperature, then reheated, and subjected to hot rolling. The steel slab may not be cooled to room temperature, and the steel slab obtained, i.e., the warm slab, may be reheated and subjected to hot rolling.

[Hot Rolling Step]

Hot Rolling Start Temperature: 1,150 to 1,270° C.

If the hot rolling start temperature is lower than 1,150° C., a rolling load becomes large, and productivity decreases. Therefore, the hot rolling start temperature is 1,150° C. or higher. A hot rolling start temperature of higher than 1,270° C. only causes an increase in the cost of heating. Therefore, the hot rolling start temperature is 1,270° C. or lower.

Finishing Delivery Temperature: 850 to 950° C.

The hot rolling must be finished in the austenite single phase region, in order to make the structure of the steel sheet uniform and to reduce anisotropy of the material properties to thereby improve the elongation and hole expandability after annealing. Therefore, the finishing delivery temperature of the hot rolling is 850° C. or higher. If the finishing delivery temperature exceeds 950° C., the structure of the hot-rolled steel sheet becomes coarse, and the properties after annealing are reduced. Therefore, the finishing delivery temperature is 950° C. or lower.

Cooling conditions after hot rolling: Starting cooling within 1 second after completion of the hot rolling, performing first cooling to 650° C. or lower at a first average cooling rate of 80° C./s or more, and performing second cooling to 585° C. or lower at a second average cooling rate of 5° C./s or more After completion of the hot rolling, the hot-rolled steel sheet is rapidly cooled to a temperature range in which ferrite transformation is suppressed and in which bainite transformation occurs and simultaneously pearlite is finely dispersed, whereby the steel sheet structure of the hot-rolled steel sheet is controlled. By controlling the structure of the hot-rolled steel sheet in the manner described above, the structure of the hot-rolled steel sheet is made uniform, and this provides the effect of finely dispersing mainly ferrite in the final steel sheet structure. Therefore, after the finishing rolling, i.e., after the hot rolling, cooling is started within 1 second after completion of the hot rolling, and the first cooling to 650° C. or lower is performed at a first average cooling rate of 80° C./s or more. If the first average cooling rate is less than 80° C./s, the amount of ferrite transformation becomes large. In this case, the steel sheet structure of the hot-rolled steel sheet becomes non-uniform, and the hole expandability and material homogeneity after annealing are reduced. Therefore, the first average cooling rate is 80° C./s or more. If the cooling temperature at the end of the first cooling (the cooling stop temperature of the first cooling) exceeds 650° C., an excessively large amount of coarse pearlite is formed, and the steel sheet structure of the hot-rolled steel sheet becomes non-uniform, so that the hole expandability and material homogeneity after annealing are reduced. Therefore, the first cooling to 650° C. or lower after the finishing rolling is performed at a first average cooling rate of 80° C./s or more. Preferably, the cooling stop temperature of the first cooling is 600° C. or higher. The first average cooling rate is the average cooling rate in the first cooling during the period from completion of the hot rolling until the cooling stop temperature is reached.

After the first cooling described above, the second cooling to 585° C. or lower is performed at a second average cooling rate of 5° C./s or more. If the second average cooling rate, which is the average cooling rate in the second cooling, is less than 5° C./s or if the cooling is performed to a temperature higher than 585° C., an excessively large amount of coarse ferrite or coarse pearlite is formed in the steel sheet structure of the hot-rolled steel sheet, and the hole expandability and material homogeneity after annealing are reduced. Therefore, in the second cooling, cooling to 585° C. or lower is performed at a second average cooling rate of 5° C./s or more. The average cooling rate in the second cooling is preferably 40° C./s or less. The second average cooling rate is the average rate of cooling from the cooling stop temperature in the first cooling to coiling temperature.

Coiling Temperature: 585° C. or Lower

After the first cooling, the second cooling to 585° C. or lower is performed at a second average cooling rate of 5° C./s or more as described above, and then the hot-rolled steel sheet is coiled. Specifically, the coiling temperature is 585° C. or lower. If the coiling temperature is higher than 585° C., excessively large amounts of ferrite and pearlite are formed. Therefore, the coiling temperature is 585° C. or lower. Preferably, the coiling temperature is 570° C. or lower. The lower limit of the coiling temperature is not particularly specified. However, if the coiling temperature is excessively low, an excessively large amount of hard martensite is formed, and the load during cold rolling becomes large. Therefore, the coiling temperature is preferably 300° C. or higher.

Preferably, after the hot-rolling step described above, an acidic step of pickling the obtained hot-rolled steel sheet is performed to remove scales in a surface layer of the hot-rolled sheet. No particular limitation is imposed on the pickling step, and the pickling step may be performed according to a routine procedure.

[Cold Rolling Step]

The hot-rolled steel sheet obtained in the hot rolling step, preferably the hot-rolled steel sheet subjected to pickling, is subjected to the cold rolling step of rolling the hot-rolled steel sheet to a prescribed sheet thickness to thereby form a cold-rolled sheet. No particular limitation is imposed on the conditions of the cold rolling, and the cold rolling may be performed according to a routine procedure.

[Annealing Step]

The annealing step is performed to allow recrystallization to proceed and to form tempered martensite in the steel sheet structure for the purpose of strengthening. Therefore, in the annealing step, the cold-rolled sheet is subjected to continuous annealing. Specifically, the cold-rolled sheet is heated to a temperature range of from 800° C. to Ac3 transformation temperature at an average heating rate of 3 to 30° C./s, held at a first soaking temperature within a temperature range of from 800° C. to the Ac3 transformation temperature for 30 seconds or longer, subjected to primary cooling to a temperature range of 650° C. or higher at a third average cooling rate of 1° C./s or more, cooled from the primary cooling finish temperature to 100° C. or lower at a fourth average cooling rate of 100 to 1,000° C./s, and then held within a second soaking temperature range of from 100 to 250° C. for 120 to 1,800 seconds.

Average Heating Rate: 3 to 30° C./s

When the nucleation rates of ferrite and austenite formed by recrystallization in a heating process during the annealing are faster than the growth rate of the recrystallized crystal grains, fine recrystallized grains can be obtained. To achieve this effect, it is important to control the heating rate during the continuous annealing. If the average heating rate is less than 3° C./s, the ferrite grains become coarse, so that the prescribed average grain diameter cannot be obtained. Therefore, the average heating rate is 3° C./s or more. Preferably, the average heating rate is 5° C./s or more. If rapid heating is performed at an average heating rate of more than 30° C./s, recrystallization is unlikely to proceed. Therefore, the average heating rate is 30° C./s or less.

First Soaking Temperature: 800° C. to Ac3 Transformation Temperature

Soaking is performed at the first soaking temperature in a temperature range of a ferrite-austenite two-phase region. If the first soaking temperature is lower than 800° C., the volume fraction of the austenite during the annealing becomes small, and the volume fraction of the tempered martensite cannot be obtained. Therefore, the first soaking temperature is 800° C. or higher. Preferably, the first soaking temperature is 820° C. or higher. If the first soaking temperature exceeds the Ac3 transformation temperature, the volume fraction of the ferrite necessary for the elongation cannot be obtained, and the crystal grains becomes further coarse. Therefore, the first soaking temperature is equal to or lower than the Ac3 transformation temperature.

In the present disclosure, the Ac3 transformation temperature (° C.) is determined from formula (2) below.

$$Ac3=910-203\times[C]^{0.5}+44.7\times[Si]-30\times[Mn]+700\times[P]+400\times[Al]+400\times[Ti]+104\times[V]+31.5\times[Mo]-11\times[Cr]-20\times[Cu]-15.2\times[Ni] \quad (2)$$

Here, [M] represents the content (mass %) of an element M.

Holding Time at the First Soaking Temperature: 30 Seconds or Longer

To allow recrystallization to proceed at the above-described first soaking temperature and to allow part of the recrystallized crystals to undergo austenite transformation, it is necessary that the holding time (first holding time) at the first soaking temperature be 30 seconds or longer. Preferably, the first holding time is 100 seconds or longer. No particular limitation is imposed on the upper limit of the first holding time, but the first holding time is preferably 600 seconds or shorter.

Primary cooling from the first soaking temperature to a primary cooling finish temperature of 650° C. or higher at a third average cooling rate of 1° C./s or more To obtain the desired volume fractions of ferrite and tempered martensite, the primary cooling (the primary cooling in the annealing step) from the first soaking temperature to a temperature range of 650° C. or higher is performed at an average cooling rate (third average cooling rate) of 1° C./s or more. If the temperature at the end of the primary cooling (the primary cooling finish temperature) is lower than 650° C. or if the third average cooling rate, which is the average cooling rate in the primary cooling, is less than 1° C./s, the volume fraction of the ferrite becomes large, and an excessively large amount of pearlite is formed, so that the desired volume fractions cannot be obtained. Therefore, the primary cooling finish temperature is 650° C. or higher, and the third average cooling rate is 1° C./s or more. Preferably, the primary cooling finish temperature is 740° C. or lower.

To ensure the volume fraction of the ferrite, the third average cooling rate is preferably 20° C./s or less.

Cooling from the Primary Cooling Finish Temperature to 100° C. or Lower at a Fourth Average Cooling Rate of 100 to 1,000° C./s Subsequent to the primary cooling, secondary cooling (secondary cooling in the annealing step) to 100° C. or lower is performed at an average cooling rate (fourth average cooling rate) of 100 to 1,000° C./s. In the temperature range from the temperature after the primary cooling to 100° C. or lower, cooling must be performed at an average cooling rate of 100 to 1,000° C./s in order to suppress pearlite transformation and bainite transformation. If the average cooling rate in the range of from the primary cooling finish temperature to 100° C. or lower is less than 100° C./s, excessively large amounts of bainite and retained austenite are formed, so that the desired volume fractions cannot be obtained. Therefore, the fourth average cooling rate is 100° C./s or more. If the average cooling rate in the secondary cooling exceeds 1,000° C./s, shrinkage cracks caused by the cooling may occur in the steel sheet. Therefore, the fourth average cooling rate is 1,000° C./s or less. Preferably, water quenching is performed as the secondary cooling.

Holding in a Second Soaking Temperature Range of from 100 to 250° C. for 120 to 1,800 Seconds In the present disclosure, the holding treatment in the second soaking temperature range corresponds to tempering treatment. This tempering treatment is performed in order to soften the martensite phase to thereby improve formability. Specifically, after the secondary cooling described above, the cold-rolled sheet is held in a temperature range of from 100 to 250° C. for 120 to 1,800 seconds to temper the martensite phase. If the tempering temperature is lower than 100° C., softening of the martensite phase is insufficient, so that the effect of improving formability is not expected. Therefore, the second soaking temperature range is 100° C. or higher. Preferably, the second soaking temperature range is 120° C. or higher. A tempering temperature of higher than 250° C. not only leads to an increase in the cost for reheating but also leads to a significant reduction in strength, so that the desired effects cannot be obtained. Therefore, the second soaking temperature range is 250° C. or lower. Preferably, the second soaking temperature range is 230° C. or lower. If the holding time in the second soaking temperature range, i.e., the tempering time, is shorter than 120 seconds, the martensite is not sufficiently softened in the second soaking temperature range, so that the effect of improving formability is not expected. Therefore, the holding time in the second soaking temperature range is 120 seconds or longer. Preferably, the holding time is 200 seconds or longer. If the holding time exceeds 1,800 seconds, the softening of the martensite proceeds excessively. In this case, the strength is reduced significantly, and the reheating time becomes long, so that the production cost increases. Therefore, the holding time in the second soaking temperature range is 1,800 seconds or shorter. Preferably, the holding time is 1,500 seconds or shorter. No limitation is imposed on the cooling method and the cooling rate after holding in the second soaking temperature range of from 100 to 250° C.

After the continuous annealing, temper rolling may be performed. A preferable range of the elongation rate is 0.1% to 2.0%. In the annealing step, hot-dip galvanization may be performed within the scope of the present disclosure to thereby obtain a hot-dip galvanized steel sheet. In addition, galvannealing may be performed after the hot-dip galvanization to obtain a hot-dip galvannealed steel sheet. The cold-rolled steel sheet may be subjected to electroplating to form an electroplated steel sheet.

EXAMPLE 1

Examples of the exemplary disclosed embodiments will next be described. However, the present disclosure is not restricted by any means to the following Examples and may be subjected to appropriate modifications within a range meeting the gist of the present disclosure, and these modifications are also included in the technical scope of the present disclosure.

Molten steel having a composition (chemical composition) shown in Table 1 with the balance being Fe and inevitable impurities was produced in a converter and formed into a slab by a continuous casting method, and then the slab was cooled to 600° C. over a cooling time shown in Table 2 and then cooled to room temperature. Then the obtained slab was reheated, subjected to hot rolling at a hot rolling start temperature of 1,250° C. under a finishing delivery temperature (FDT) condition shown in Table 2, cooled to a first cooling temperature at a first average cooling rate (cooling rate 1) shown in Table 2, then cooled at a second average cooling rate (cooling rate 2), and coiled at a coiling temperature (CT) to obtain a hot-rolled steel sheet. Then the obtained hot-rolled steel sheet was pickled and subjected to cold-rolling to produce a cold-rolled sheet. Then the cold-rolled steel sheet was subjected to continuous annealing. Specifically, the cold-rolled steel sheet was heated at an average heating rate shown in Table 2, held at a first soaking temperature shown in Table 2 for a holding time (first holding time) shown in Table 2, cooled to a primary cooling finish temperature at a third average cooling rate (cooling rate 3) shown in Table 2, cooled to a secondary cooling temperature at a fourth average cooling rate (cooling rate 4) shown in Table 2, heated to a tempering temperature shown in Table 2, held for a tempering time shown in Table 2, and then cooled to room temperature.

The properties of the cold-rolled steel sheets produced as described above were evaluated as follows. The results are shown in Table 3.

[Microstructures of Steel Sheets]

The volume fractions of the ferrite and tempered martensite in each steel sheet were determined as follows. A thicknesswise cross section of the steel sheet parallel to the rolling direction was polished, etched with 3% nital, and observed at a magnification of 2,000× using an SEM (scanning electron microscope) and Image-Pro from Media Cybernetics. Specifically, area fractions were measured by a point-count method (according to ASTM E562-83 (1988)), and the measured area fractions were used as the volume fractions. The average crystal grain diameter of the ferrite was determined as follows. Using the Image-Pro described above, photographs in which ferrite crystal grains had been identified in advance were taken from steel sheet structure photographs. This allows the area of each crystal grain to be computed. Then the equivalent circular diameter of each crystal grain was computed, and the average of the computed values was determined.

The volume fraction of the retained austenite in a steel sheet was determined as follows. The steel sheet was polished in its thickness direction until a surface at a position one-fourth of the thickness appeared, and the volume fraction was determined using the X-ray diffraction intensity from the surface at the position one-fourth of the thickness. The Kα line of Mo was used as a radiation source, and the integrated intensities of X-ray diffraction lines from the {200} plane, {211} plane, and {220} plane of ferrite iron and the {200} plane, {220} plane, and {311} plane of austenite were measured at an acceleration voltage of 50 keV using an X-ray diffraction method (device: RINT 2200 manufactured by Rigaku). These measurement values were used to determine the volume fraction of the retained austenite using a computation formula described in "X-ray diffraction handbook" (2000), Rigaku Corporation, pp. 26, 62-64.

The mean free path of the ferrite was determined as follows. Using the Image-Pro described above, the barycenter of the ferrite was determined. Then, on the precondition that the ferrite was dispersed uniformly without extremely uneven distribution, the mean free path was computed using formula (1) below.

[Formula 1]

$$L_M = \frac{d_M}{2}\left(\frac{4\pi}{3f}\right)^{\frac{1}{3}} \quad (1)$$

In the above formula, $L_M$ is the mean free path, $d_M$ is the average crystal grain diameter (μm) of the ferrite, π is the circular constant, and f is the volume fraction of the ferrite (=the volume fraction of the ferrite (%)/100).

[Tensile Properties]

JIS No. 5 test pieces were taken from each of the obtained cold-rolled steel sheets. Specifically, the test pieces were taken from a widthwise central portion of the sheet and positions one-eighth of the width from opposite widthwise edges (positions one-eighth of the total width) such that a tensile direction was parallel to the rolling direction. A tensile test was performed according to JIS Z2241 (2010) to measure tensile strength (TS) and total elongation (EL). For each of the TS and EL measured, the average of the three points, i.e., the widthwise central portion of the sheet and the positions one-eighth of the width (the positions one-eighth of the total width from opposite widthwise edges) was determined. The determined average values were used as the TS and El of the produced cold-rolled steel sheet and are shown in Table 3.

For the TS measured as described above, the difference between the value at the widthwise central portion of the sheet and the value at the positions one-eighth of the width of the sheet (the average of the values at the two positions one-eighth of the width of the sheet from the opposite edges) (the absolute value of {(the characteristic value at the widthwise central portion of the sheet)−(the characteristic value at the positions one-eighth of the width of the sheet)}) was computed as ΔTS. In the present disclosure, when ΔTS≤40 MPa holds, the material homogeneity is judged as good.

[Hole Expandability (Stretch Flangeability)]

As for the hole expandability, a hole expansion ratio (λ) was measured according to The Japan Iron and Steel Federation Standard (JFS T1001 (1996)). Specifically, a hole with 10 mm ϕ was punched at a clearance of 12.5% of the sheet thickness, and the punched steel sheet was placed on a testing machine such that burrs were on the die side, and then a hole expansion test in which a 60° conical punch was used for forming was performed to measure the hole expansion ratio (λ). When the λ(%) of a steel sheet is 30% or more, the hole expandability (stretch flangeability) of the steel sheet is judged as good.

[Delayed Fracture Resistance]

Each of the obtained cold-rolled steel sheets was cut into a test piece of 30 mm×100 mm with its lengthwise direction parallel to the rolling direction, and the end faces of the test piece were ground. The test piece was bent 180° using a punch with a forward end having a radius of curvature of 10 mm. Springback occurred in the bent test piece, and the bent test piece was tightened with a bolt such that the inner spacing was 20 mm to thereby apply stress to the test piece. Then the test piece was immersed in hydrochloric acid with pH=2 at 25° C., and the time until fracture was measured for a maximum duration of 100 hours. The delayed fracture resistance of a test piece with no cracks until 100 hours is judges as good (A), and the delayed fracture resistance of a test piece with cracks was judged as poor (C).

As can be seen from the results shown in Table 3, in all Inventive Examples, good formability is obtained. Specifically, the tensile strength is 1,450 MPa or more, the total elongation is 10.5% or more, and the hole expansion ratio is 30% or more. In addition, the delayed fracture resistance and the material homogeneity are good. However, in Comparative Examples, the steel sheet structure does not satisfy the ranges of the present disclosure. Therefore, at least one of the properties including tensile strength, elongation, hole expansion ratio, delayed fracture resistance, and material homogeneity is poor.

TABLE 1

| Type of | Chemical composition (mass %) | | | | | | | | | | | |
|---|---|---|---|---|---|---|---|---|---|---|---|---|
| steel | C | Si | Mn | P | S | Al | N | Ti | B | Other | Ac3 (° C.) | Remarks |
| A | 0.20 | 1.45 | 2.05 | 0.01 | 0.002 | 0.03 | 0.002 | 0.015 | 0.0015 | — | 848 | Suitable steel |
| B | 0.22 | 1.71 | 2.11 | 0.01 | 0.002 | 0.03 | 0.002 | 0.013 | 0.0016 | — | 852 | Suitable steel |
| C | 0.19 | 1.39 | 2.34 | 0.01 | 0.001 | 0.03 | 0.002 | 0.011 | 0.0025 | Nb: 0.03 | 837 | Suitable steel |
| D | 0.18 | 1.54 | 2.09 | 0.01 | 0.002 | 0.02 | 0.002 | 0.006 | 0.0031 | V: 0.02 | 849 | Suitable steel |
| E | 0.22 | 1.88 | 1.89 | 0.01 | 0.001 | 0.02 | 0.003 | 0.015 | 0.0009 | Cr: 0.18 | 861 | Suitable steel |
| F | 0.18 | 1.36 | 2.21 | 0.01 | 0.001 | 0.03 | 0.001 | 0.030 | 0.0015 | Mo: 0.15 | 854 | Suitable steel |
| G | 0.21 | 2.01 | 1.91 | 0.01 | 0.002 | 0.03 | 0.002 | 0.022 | 0.0034 | Cu: 0.18 | 874 | Suitable steel |
| H | 0.18 | 1.21 | 2.31 | 0.01 | 0.002 | 0.03 | 0.002 | 0.025 | 0.0015 | Ni: 0.22 | 834 | Suitable steel |
| I | 0.19 | 1.34 | 2.15 | 0.02 | 0.002 | 0.03 | 0.002 | 0.012 | 0.0021 | Ca: 0.0028 | 848 | Suitable steel |
| J | 0.21 | 1.39 | 2.25 | 0.01 | 0.002 | 0.03 | 0.002 | 0.024 | 0.0036 | REM: 0.0028 | 840 | Suitable steel |
| K | 0.12 | 1.65 | 2.35 | 0.01 | 0.002 | 0.03 | 0.002 | 0.015 | 0.0030 | — | 868 | Comparative Example |
| L | 0.18 | 0.89 | 2.21 | 0.01 | 0.002 | 0.02 | 0.003 | 0.019 | 0.0012 | — | 820 | Comparative Example |
| M | 0.20 | 1.94 | 1.53 | 0.01 | 0.002 | 0.03 | 0.003 | 0.015 | 0.0020 | — | 885 | Comparative Example |
| N | 0.17 | 1.81 | 3.82 | 0.02 | 0.002 | 0.04 | 0.003 | 0.019 | 0.0019 | — | 830 | Comparative Example |

Underlined figures are outside the scope of the present invention

TABLE 2

| Sample number | Type of steel | Cooling time after completion of continuous annealing until 600° C. (h) | Hot rolling: FDT (° C.) | Time until cooling is started (s) | Cooling rate 1 (° C./s) | First cooling temperature (° C.) | Cooling rate 2 (° C./s) | CT (° C.) | Continuous annealing: Average heating rate (° C./s) | First soaking temperature (° C.) |
|---|---|---|---|---|---|---|---|---|---|---|
| 1 | A | 4 | 900 | 0.5 | 90 | 600 | 20 | 530 | 6 | 830 |
| 2 | A | 4 | 900 | 0.5 | 100 | 600 | 20 | 530 | 5 | 840 |
| 3 | B | 4 | 900 | 0.5 | 100 | 550 | 20 | 470 | 10 | 850 |
| 4 | B | 5.5 | 900 | 0.5 | 100 | 600 | 20 | 560 | 10 | 850 |
| 5 | B | 4 | 900 | 0.5 | 100 | 640 | 20 | 530 | 10 | 820 |
| 6 | C | 4 | 900 | 0.5 | 100 | 600 | 10 | 530 | 10 | 830 |
| 7 | D | 5 | 900 | 0.5 | 150 | 600 | 20 | 500 | 5 | 830 |
| 8 | E | 4 | 900 | 0.5 | 100 | 620 | 35 | 450 | 25 | 840 |
| 9 | F | 4 | 900 | 0.5 | 80 | 620 | 20 | 530 | 10 | 840 |
| 10 | G | 4 | 900 | 0.5 | 100 | 600 | 20 | 500 | 10 | 840 |
| 11 | H | 3 | 900 | 0.5 | 120 | 600 | 20 | 500 | 5 | 820 |
| 12 | I | 4 | 900 | 0.5 | 100 | 620 | 20 | 500 | 10 | 840 |
| 13 | J | 4 | 900 | 0.5 | 120 | 600 | 20 | 530 | 10 | 820 |
| 14 | A | 9 | 900 | 0.5 | 100 | 620 | 20 | 530 | 10 | 840 |
| 15 | A | 4 | 900 | 0.5 | 40 | 600 | 20 | 530 | 10 | 840 |
| 16 | A | 4 | 900 | 0.5 | 80 | 750 | 20 | 530 | 10 | 830 |
| 17 | B | 4 | 900 | 0.5 | 100 | 600 | 2 | 530 | 10 | 830 |
| 18 | A | 4 | 900 | 0.5 | 100 | 680 | 20 | 660 | 10 | 830 |
| 19 | B | 4 | 900 | 0.5 | 100 | 620 | 20 | 530 | 1 | 820 |
| 20 | A | 4 | 900 | 0.5 | 130 | 600 | 20 | 530 | 15 | 760 |
| 21 | A | 4 | 900 | 0.5 | 100 | 620 | 25 | 530 | 10 | 830 |
| 22 | A | 4 | 900 | 0.5 | 100 | 600 | 15 | 500 | 10 | 800 |
| 23 | A | 4 | 900 | 0.5 | 100 | 600 | 20 | 530 | 10 | 830 |
| 24 | A | 4 | 900 | 0.5 | 100 | 600 | 20 | 500 | 10 | 840 |
| 25 | A | 4 | 900 | 0.5 | 100 | 580 | 20 | 550 | 10 | 820 |
| 26 | K | 4 | 900 | 0.5 | 150 | 570 | 20 | 550 | 10 | 850 |
| 27 | L | 4 | 900 | 0.5 | 100 | 600 | 20 | 500 | 15 | 810 |
| 28 | M | 4 | 900 | 0.5 | 100 | 550 | 20 | 500 | 10 | 840 |
| 29 | N | 4 | 900 | 0.5 | 100 | 600 | 20 | 530 | 10 | 825 |

| Sample number | Continuous annealing: First holding time (s) | Cooling rate 3 (° C./s) | Primary cooling finish temperature (° C.) | Cooling rate 4 (° C./s) | Secondary cooling temperature (° C.) | Tempering temperature (° C.) | Tempering time (s) |
|---|---|---|---|---|---|---|---|
| 1 | 300 | 3 | 700 | 880 | 25 | 200 | 600 |
| 2 | 350 | 3 | 720 | 870 | 28 | 200 | 500 |
| 3 | 300 | 3 | 680 | 900 | 25 | 200 | 600 |
| 4 | 350 | 4 | 720 | 980 | 21 | 220 | 600 |
| 5 | 350 | 4 | 700 | 840 | 28 | 200 | 600 |
| 6 | 350 | 4 | 700 | 880 | 15 | 200 | 1000 |
| 7 | 350 | 3 | 680 | 880 | 14 | 220 | 600 |
| 8 | 350 | 3 | 700 | 880 | 20 | 180 | 600 |
| 9 | 500 | 5 | 720 | 860 | 25 | 180 | 600 |
| 10 | 350 | 3 | 700 | 880 | 20 | 180 | 600 |
| 11 | 500 | 3 | 700 | 900 | 20 | 180 | 600 |
| 12 | 300 | 3 | 700 | 880 | 24 | 220 | 200 |
| 13 | 300 | 3 | 700 | 880 | 20 | 220 | 500 |
| 14 | 350 | 3 | 700 | 890 | 20 | 200 | 600 |
| 15 | 300 | 3 | 700 | 900 | 20 | 200 | 600 |
| 16 | 300 | 3 | 700 | 900 | 20 | 200 | 600 |
| 17 | 300 | 3 | 680 | 880 | 20 | 200 | 600 |
| 18 | 300 | 3 | 720 | 880 | 20 | 200 | 600 |
| 19 | 300 | 3 | 700 | 890 | 24 | 200 | 600 |
| 20 | 300 | 3 | 680 | 900 | 19 | 120 | 600 |
| 21 | 200 | 0.2 | 700 | 800 | 18 | 200 | 600 |
| 22 | 250 | 1 | 450 | 880 | 18 | 200 | 600 |
| 23 | 150 | 3 | 750 | 890 | 31 | 550 | 600 |
| 24 | 300 | 3 | 700 | 880 | 15 | 50 | 500 |
| 25 | 250 | 3 | 680 | 895 | 25 | 200 | 30 |
| 26 | 300 | 3 | 700 | 880 | 25 | 200 | 600 |
| 27 | 300 | 4 | 700 | 990 | 24 | 200 | 500 |
| 28 | 300 | 4 | 680 | 880 | 24 | 180 | 500 |
| 29 | 300 | 3 | 700 | 880 | 24 | 200 | 600 |

Underlined figures are outside the scope of the present invention

TABLE 3

| | Steel sheet structure | | | | | | | | | | | |
|---|---|---|---|---|---|---|---|---|---|---|---|---|
| | Ferrite | | | Tempered | Retained | | | | | Hole | | |
| | Volume | Average grain | Average mean | martensite Volume | austenite Volume | Remainder | Tensile properties | | | expansion ratio | Delayed fracture | |
| Sample number | fraction (%) | diameter (μm) | free path (μm) | fraction (%) | fraction (%) | structure Type | TS (MPa) | EL (%) | Δ TS (MPa) | λ (%) | re-sistance | Remarks |
| 1 | 10 | 3 | 5.2 | 90 | — | — | 1520 | 11.6 | 31 | 34 | A | Inventive Examples |
| 2 | 7 | 3 | 5.9 | 93 | — | — | 1521 | 11.3 | 34 | 31 | A | Inventive Examples |
| 3 | 11 | 2 | 3.4 | 89 | — | — | 1489 | 11.4 | 34 | 35 | A | Inventive Examples |
| 4 | 7 | 3 | 5.9 | 93 | — | — | 1495 | 11.9 | 29 | 32 | A | Inventive Examples |
| 5 | 8 | 3 | 5.6 | 92 | — | — | 1481 | 11.4 | 25 | 31 | A | Inventive Examples |
| 6 | 12 | 4 | 6.5 | 88 | — | — | 1480 | 11.7 | 31 | 34 | A | Inventive Examples |
| 7 | 10 | 4 | 6.9 | 90 | — | — | 1499 | 11.8 | 31 | 31 | A | Inventive Examples |
| 8 | 8 | 3 | 5.6 | 92 | — | — | 1497 | 12.1 | 28 | 33 | A | Inventive Examples |
| 9 | 7 | 3 | 5.9 | 93 | — | — | 1505 | 11.6 | 29 | 31 | A | Inventive Examples |
| 10 | 10 | 3 | 5.2 | 90 | — | — | 1501 | 11.3 | 31 | 34 | A | Inventive Examples |
| 11 | 11 | 3 | 5.0 | 87 | 2 | — | 1502 | 12.3 | 34 | 31 | A | Inventive Examples |
| 12 | 9 | 3 | 5.4 | 91 | — | — | 1497 | 11.1 | 33 | 30 | A | Inventive Examples |
| 13 | 10 | 3 | 5.2 | 90 | — | — | 1511 | 11.4 | 30 | 37 | A | Inventive Examples |
| 14 | 9 | 5 | 9.0 | 91 | — | — | 1488 | 11.0 | 52 | 23 | A | Comparative Example |
| 15 | 7 | 4 | 7.8 | 93 | — | — | 1475 | 11.6 | 46 | 19 | A | Comparative Example |
| 16 | 10 | 5 | 8.7 | 90 | — | — | 1525 | 10.8 | 61 | 15 | A | Comparative Example |
| 17 | 8 | 5 | 9.4 | 92 | — | — | 1480 | 10.9 | 55 | 25 | A | Comparative Example |
| 18 | 10 | 5 | 8.7 | 90 | — | — | 1499 | 11.1 | 59 | 20 | A | Comparative Example |
| 19 | 16 | 6 | 8.9 | 84 | — | — | 1465 | 11.0 | 49 | 24 | A | Comparative Example |
| 20 | 22 | 4 | 5.3 | 78 | — | — | 1451 | 13.3 | 43 | 12 | A | Comparative Example |
| 21 | 17 | 4 | 5.8 | 77 | — | P | 1466 | 10.1 | 39 | 31 | A | Comparative Example |
| 22 | 16 | 4 | 5.9 | 79 | 2 | B, P | 1454 | 9.7 | 42 | 32 | A | Comparative Example |
| 23 | 11 | 3 | 5.5 | 79 | — | P | 1361 | 11.0 | 46 | 33 | A | Comparative Example |
| 24 | 7 | 3 | 7.9 | 93 | — | — | 1584 | 9.8 | 45 | 19 | A | Comparative Example |
| 25 | 12 | 4 | 7.7 | 88 | — | — | 1569 | 10.1 | 50 | 12 | A | Comparative Example |
| 26 | 22 | 4 | 5.3 | 78 | — | — | 1429 | 12.5 | 35 | 25 | A | Comparative Example |
| 27 | 4 | 2 | 4.7 | 96 | — | — | 1501 | 10.1 | 38 | 22 | A | Comparative Example |
| 28 | 21 | 4 | 5.4 | 75 | — | P | 1433 | 13.1 | 49 | 33 | A | Comparative Example |
| 29 | 4 | 2 | 4.7 | 96 | — | — | 1533 | 10.6 | 42 | 16 | C | Comparative Example |

Underlined figures are outside the scope of the present invention
Remainder structure: B—bainite, P—perlite

The invention claimed is:

1. A high-strength cold-rolled steel sheet with excellent material homogeneity, the high-strength cold-rolled steel sheet having a chemical composition comprising;

C: 0.15 to 0.25%, by mass %:
Si: 1.2 to 2.2%, by mass %;
Mn: 1.7 to 2.5%, by mass %;
P: 0.05% or less, by mass %;
S: 0.005% or less, by mass %;
Al: 0.01 to 0.10%, by mass %;
N: 0.006% or less, by mass %;
Ti: 0.003 to 0.030%, by mass %;
B: 0.0002 to 0.0050%, by mass %; and
Fe and inevitable impurities,
wherein:

the steel sheet has a microstructure including (i) ferrite having an average crystal grain diameter of 4μm or less at a volume fraction of 5 to 20%, (ii) retained austenite at a volume fraction of 5% or less, including 0%, and (iii) tempered martensite at a volume fraction of 80 to 95%, and the ferrite has a mean free path of 3.0 to 7.5 μm.

2. The high-strength cold-rolled steel sheet with excellent material homogeneity according to claim 1, wherein the chemical composition further comprises Nb: 0.05% or less, by mass %.

3. The high-strength cold-rolled steel sheet with excellent material homogeneity according to claim 1, wherein the chemical composition further comprises V: 0.01 to 0.30%, by mass %.

4. The high-strength cold-rolled steel sheet with excellent material homogeneity according to claim 1, wherein the chemical composition further comprises at least one selected from Cr: 0.30% or less, by mass % and Mo: 0.30% or less, by mass %.

5. The high-strength cold-rolled steel sheet with excellent material homogeneity according to claim 1, wherein the chemical composition further comprises at least one selected from Cu: 0.50% or less, by mass % and Ni: 0.50% less, by mass %.

6. The high-strength cold-rolled steel sheet with excellent material homogeneity according to claim 1, wherein the chemical composition comprises 0.0050% or less in total, by mass % of Ca and/or a REM.

7. The high-strength cold-rolled steel sheet with excellent material homogeneity according to claim 2, wherein the chemical composition further comprises V: 0.01 to 0.30%, by mass %.

8. The high-strength cold-rolled steel sheet with excellent material homogeneity according to claim 2, wherein the chemical composition further comprises at least one selected from Cr: 0.30% or less, by mass % and Mo: 0.30% or less, by mass %.

9. The high-strength cold-rolled steel sheet with excellent material homogeneity according to claim 3, wherein the chemical composition further comprises at least one selected from Cr: 0.30% or less, by mass % and Mo: 0.30% or less, by mass %.

10. The high-strength cold-rolled steel sheet with excellent material homogeneity according to claim 2, wherein the chemical composition further comprises at least one selected from Cu: 0.50% or less, by mass % and Ni: 0.50% or less, by mass %.

11. The high-strength cold-rolled steel sheet with excellent material homogeneity according to claim 3, wherein the chemical composition further comprises at least one selected from Cu: 0.50% or less, by mass % and Ni: 0.50% or less, by mass %.

12. The high-strength cold-rolled steel sheet with excellent material homogeneity according to claim 4, wherein the chemical composition further comprises at least one selected from Cu: 0.50% or less, by mass % and Ni: 0.50% or less, by mass %.

13. The high-strength cold-rolled steel sheet with excellent material homogeneity according to claim 2, wherein the chemical composition comprises 0.0050% or less in total, by mass % of Ca and/or a REM.

14. The high-strength cold-rolled steel sheet with excellent material homogeneity according to claim 3, wherein the chemical composition comprises 0.0050% or less in total, by mass % of Ca and/or a REM.

15. The high-strength cold-rolled steel sheet with excellent material homogeneity according to claim 4, wherein the chemical composition comprises 0.0050% or less in total, by mass % of Ca and/or a REM.

16. The high-strength cold-rolled steel sheet with excellent material homogeneity according to claim 5, wherein the chemical composition comprises 0.0050% or less in total, by mass % of Ca and/or a REM.

17. A production method for a high-strength cold-rolled steel sheet with excellent material homogeneity, the production method comprising:

continuously casting molten steel to obtain a slab, the molten steel having a chemical composition including:

C: 0.15 to 0.25%, by mass %,
Si: 1.2 to 2.2%, by mass %,
Mn: 1.7 to 2.5%, by mass %,
P: 0.05% or less, by mass %,
S: 0.005% or less, by mass %,
Al: 0.01 to 0.10%, by mass %,
N: 0.006% Of less, by mass %,
Ti: 0.003 to 0.030%, by mass %,
B: 0.0002 to 0.0050%, by mass %, and
Fe and inevitable impurities;

cooling the slab to 600° C. within 6 hours from a termination of the continuous casting;

reheating the cooled slab;

after reheating the slab, hot rolling the slab under the conditions of a hot rolling start temperature of 1,150 to 1,270° C. and a finishing delivery temperature of 850 to 950° C. to produce a hot-rolled steel sheet;

starting cooling of the hot-rolled steel sheet within 1 second after completion of the hot rolling;

performing first cooling of the hot-rolled steel sheet to 650° C. or lower at a first average cooling rate of 80° C/s or more;

performing second cooling of the hot-rolled steel sheet to 585° C. or lower at a second average cooling rate of 5° C/s or more;

performing coiling of the hot-rolled steel sheet;

then, after the coiling, performing cold rolling of the hot-rolled steel sheet; and performing continuous annealing that includes;

(i) heating to a temperature range of from 800° C. to Ac3 transformation temperature at an average heating rate of 3 to 30° C/s, (ii) holding at a first soaking temperature within a temperature range of from 800° C. to the Ac3 transformation temperature for 30 seconds or longer, (iii) performing primary cooling to a primary cooling finish temperature of 650° C. or higher at a third average cooling rate of 1° C/s or more, (iv) performing cooling from the primary cooling finish temperature to 100° C. or lower at a fourth average cooling rate of 100 to 1,000° C/s, and (v) then, after step (iv), holding in a second soaking temperature range of from 100 to 250° C. for 120 to 1,800 seconds.

18. The method according to claim 17, wherein:

the steel sheet has a microstructure including (i) ferrite having an average crystal grain diameter of 4μm or less at a volume fraction of 5 to 20%, (ii) retained austenite at a volume fraction of 5% or less, including 0%, and (iii) tempered martensite at a volume fraction of 80 to 95%, and the ferrite has a mean free path of 3.0 to 7.5 μm.

* * * * *